US007878135B1

(12) United States Patent
Chamers

(10) Patent No.: US 7,878,135 B1
(45) Date of Patent: Feb. 1, 2011

(54) SWING-UP RUDDER FOR SMALL BOAT

(75) Inventor: Curtis D. Chamers, Muskegon, MI (US)

(73) Assignee: Nauticraft Corporation, Muskegon, MI (US)

( * ) Notice: Subject to any disclaimer, the term of this patent is extended or adjusted under 35 U.S.C. 154(b) by 443 days.

(21) Appl. No.: 12/117,374

(22) Filed: May 8, 2008

Related U.S. Application Data

(60) Provisional application No. 60/916,823, filed on May 9, 2007.

(51) Int. Cl.
*B63H 25/06* (2006.01)
*B63H 25/38* (2006.01)

(52) U.S. Cl. ..... 114/162; 114/165

(58) Field of Classification Search ..... 114/39.15, 114/39.24, 127–143, 149, 152, 162–172
See application file for complete search history.

(56) References Cited

U.S. PATENT DOCUMENTS 4,088,088 A * 5/1978 Proctor ..... 114/165
4,231,309 A * 11/1980 Pelletier ..... 114/162
4,372,241 A * 2/1983 Tritt ..... 114/162

FOREIGN PATENT DOCUMENTS

DE 3841624 A1 * 6/1990

* cited by examiner

*Primary Examiner*—Ajay Vasudeva
(74) *Attorney, Agent, or Firm*—McGarry Bair PC

(57) ABSTRACT

A kick-up rudder mechanism for small, tiller-steered sailboats. The rudder has a two-position pivot that allows the rudder to kick up and drop back down automatically when it hits and then clears an underwater obstacle; to be raised and lowered manually with fore-and-aft motion of the tiller; and to be secured against unwanted kick-up with a vertically releasable fore-aft locking connection between the tiller and the rudder housing.

15 Claims, 5 Drawing Sheets

SWING-UP RUDDER FOR SMALL BOAT

CROSS-REFERENCE TO RELATED APPLICATIONS

This application claims priority to U.S. Provisional Patent Application Ser. No. 60/916,823, filed May 9, 2007, all of which is incorporated herein by reference.

BACKGROUND OF THE INVENTION

1. Field of the Invention

The invention relates to a swing-up rudder for small sailboats of the type whose rudders are steered with hand tillers.

2. Description of Related Art

Small sailboats are generally steered with a rudder pivoted by a hand-operated tiller. To avoid rudder damage when the sailboat is in shallow water or being run ashore, or when the rudder encounters an underwater obstacle, rudder blades are typically made to pivot back and up out of harm's way. These are commonly called "kick-up" rudders.

Because the forward passage of the boat through the water tends to exert a kick-up type force on the leading edge of the rudder blade, rudder pivot mechanisms usually include a mechanical system to bias the rudder blade down into its normal sailing position. Prior solutions include combinations of springs, friction members, and over-center mechanisms that keep the rudder in place while the boat is sailing, but allow the rudder to pivot up and back when needed. These bias mechanisms generally work well for automatic operation, i.e. when the rudder is forced back by contact with the lake bottom or collision with an underwater obstacle, but they are often difficult for a sailor to operate manually from the cockpit. For example, some prior rudder kick-up mechanisms require the operator to grasp the rudder blade directly to push it back down into the water, which is difficult while keeping a hand on the tiller to steer the boat.

Other prior rudder pivot mechanisms mount the rudder blade for manual pivotal movement into and out of the water using fore-and-aft or up-and-down movement of the tiller handle. However, these mechanisms use a bracket to pivotally mount the rudder blade to the boat and the bracket is pivotally mounted for rotation about a horizontal axis at an upper portion and releasably held in a detent at a lower portion of the bracket. Although the detent can be tightened and loosened to retain the rudder in a down position and to raise the rudder, the rudder tends to pop out of the detent during lateral force on the rudder during heeling of the sailboat, resulting in loss of control of the sailboat.

SUMMARY OF THE INVENTION

According to the invention, a kick-up rudder mechanism for a sailboat in which the rudder is steered manually with a hand tiller comprises a rudder housing, a rudder blade mounted to the rudder housing for pivotal movement about a generally horizontal axis between a raised position and a lower position and for linear movement along a generally vertical path when the rudder blade is in the lower position, a tiller pivotally connected to the rudder blade, and a vertically-releasable fore-aft locking connection between the tiller and the rudder housing.

In one embodiment, either the rudder blade or the rudder housing includes an elongated vertical pivot slot, and the other has a transverse pivot positioned in the slot, such that the rudder blade is mounted for pivotal and linear movement with respect to the rudder housing, as described above. The slot includes a first upper pivot end that normally rests on the transverse pivot when the rudder blade is in the rudder-down position, and a second lower pivot end that receives the transverse pivot when the rudder blade is shifted vertically up by a collision with an underwater obstacle in the rudder-down position.

In a preferred embodiment, the slot is so shaped and positioned so that the rudder blade can be shifted horizontally forward between the first and second pivot ends in the rudder-up position to retain the rudder blade in the rudder-up position until it is intentionally shifted back using the tiller.

The kick-up rudder blade according to the invention is held in its down and up positions by the weight of the rudder blade acting through a two-position pivot mechanism. The pivot mechanism responds promptly and easily to collision and manual operation alike, and keeps the rudder blade securely down during normal sailing.

Further, the tiller has its own pivot connection to an upper rear cam (an over-center "ear") portion of the rudder blade located above and behind the rudder blade's pivot connection to the rudder housing. Moving the tiller fore and aft pivots the rudder blade up and down. The rudder blade pivots through an elongated two-position pivot slot riding on a transverse rudder housing pin. The rudder is biased to the down position on the pivot pin by the weight of the rudder blade and its over-center connection to the tiller, and locked in the down position by a vertically-released fore-aft locking connection between the tiller and the rudder housing.

The fore-aft locking connection is released automatically by the initial upward component of collision force on the rudder blade, which drives the rudder blade vertically on the pivot, and simultaneously releases the fore-aft locking connection to permit the tiller to move forward (and the rudder blade to pivot up) under continued force on the rudder.

The fore-aft locking connection is released manually when the operator lifts the tiller upward on its pivot connection to the rudder. The tiller can then be pulled forward to pivot the rudder blade up.

In a preferred embodiment, an upper leading edge of the rudder blade is radiused for rotational sliding contact with a fixed cam pin on the rudder housing as the rudder blade pivots. In the preferred form, the rudder's radiused edge ends in a locking notch that is aligned with the cam pin when the rudder is fully raised, (approximately 90 degrees or clear of the water), and the notch can be pulled horizontally onto the cam pin via the tiller to lock the rudder in the up position. Returning the rudder blade to the down (sailing) position is done by pushing back on the tiller handle, which releases the locking notch from the cam pin until it is pushed back off the cam pin via the tiller.

These and other features and advantages of the invention will become apparent from the detailed description below, in light of the accompanying drawings.

DESCRIPTION OF THE PREFERRED EMBODIMENT

Figure 1:
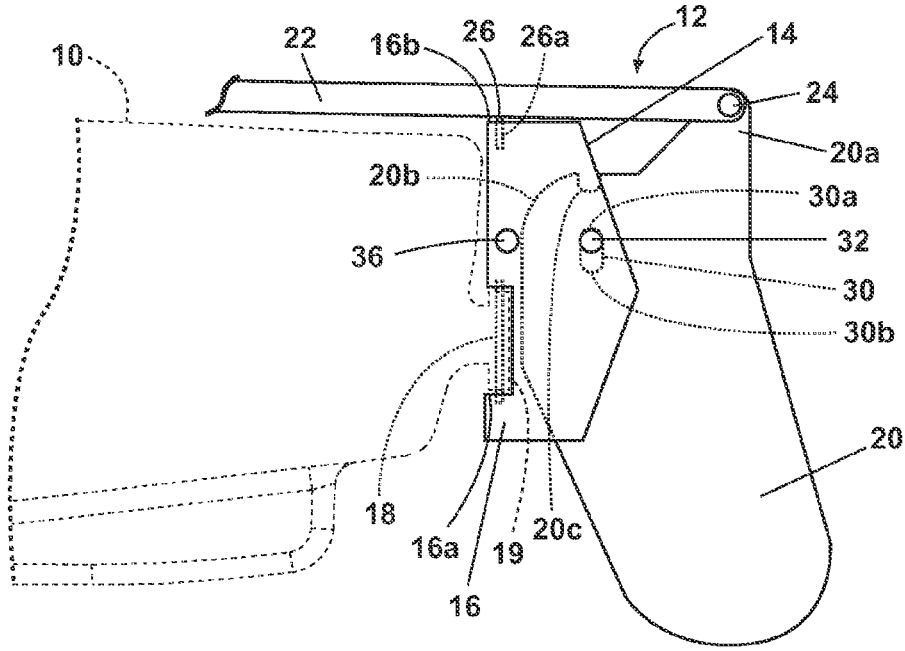
FIG. 1 is a side elevation view of a sailboat rudder mechanism according to the present invention, with the rudder blade locked in its normal (down) sailing position.
Figure 1A:
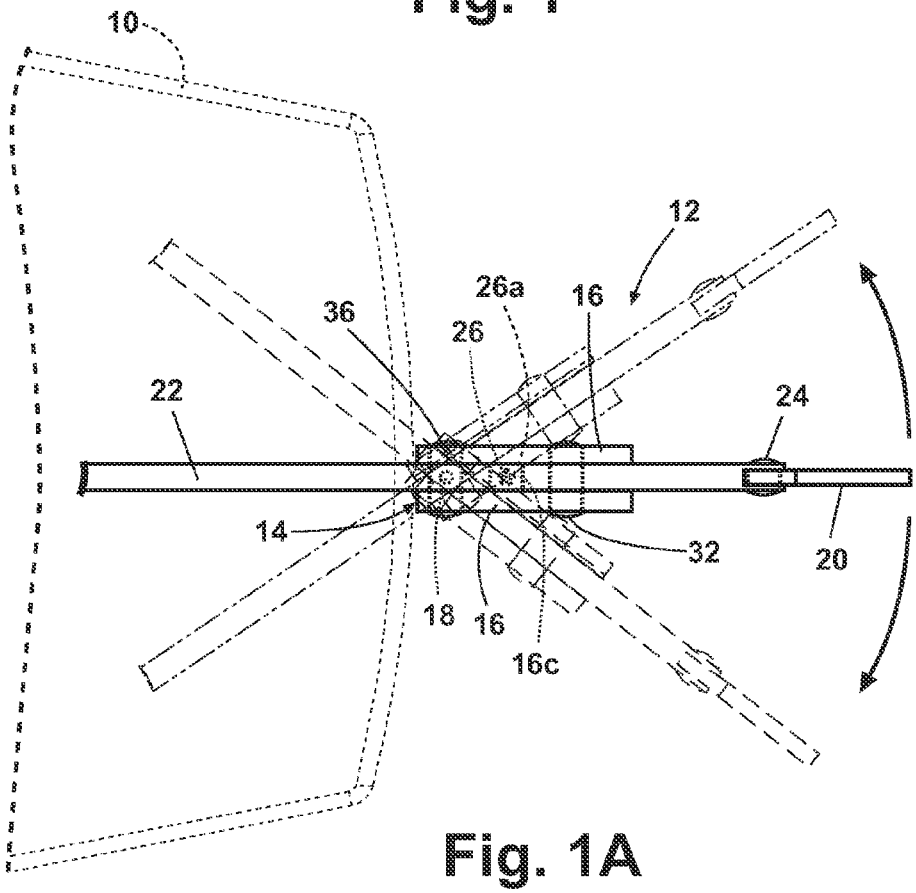
FIG. 1A is a top plan view of the rudder of FIG. 1, with different steering positions shown in phantom.

FIGS. 1 and 1A show the schematic outline of an ordinary small sailboat 10 equipped with a rudder mechanism 12 according to the invention. A rudder housing 14 in the form of a pair of spaced rudder holder plates 16 is mounted for pivotal movement about a generally vertical axis on the stern of the sailboat, for example, by connecting inset portions 16*a* of the rudder holder plates to a vertical pivot pin or "pintle" 18 that extends through gudgeon(s) 19 on the boat in known fashion. Different rudder housing pivot connections to the boat will be known to those skilled in the art, and are not critical to the present invention.

Rudder mechanism 12 further includes a rudder blade 20 mounted to the rudder housing 14 between rudder housing plates 16 for pivotal movement about the pivot pin 18 to steer the boat, and for vertical pivotal movement about a generally horizontal axis through a pivot pin 32. A hand tiller 22 is pivotally connected at a rear portion thereof to an upper rear "ear" 20*a* of the rudder blade 20 through pivot pin 24 for manual manipulation of the rudder blade through both vertical and horizontal pivotal movement. Tiller 22 extends forwardly to a point (not shown) where it can be conveniently operated by a person in the boat's cockpit.

Tiller 22 includes a fore-aft locking member, in the illustrated embodiment a stud or pin 26 that mates vertically with a receiver or receptacle 26*a* on the rudder housing 14. In the illustrated example, the pivot pin connection of tiller 22 to rudder blade 20 centers the tiller in line with the rudder blade (FIG. 1A), and locking stud receiver 26*a* is a simple blind bore formed in a spacer 16*c* between the upper edges 16*b* of rudder holder plates 16. It will be understood that although tiller 22 is shown aligned with the center of the rudder blade 20, and that the fore-aft locking connection 26, 26*a* between the tiller and rudder housing is shown aligned with the center of the rudder housing, one or both of the tiller/rudder connection and the fore-aft locking connection could be offset to port or starboard from the centerline of the rudder and rudder housing. It will also be understood that other vertically-releasable fore-aft locking connections could be used in place of the illustrated stud-and-hole connection, which is currently preferred.

Figure 4:
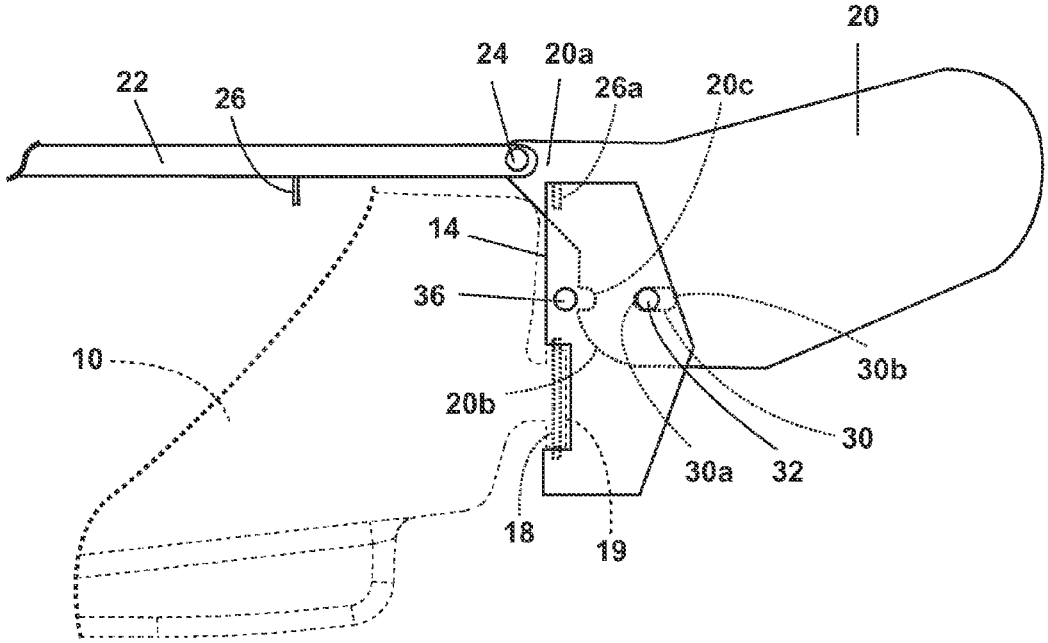
FIG. 4 shows the rudder blade fully manually raised with the tiller, but not yet locked in the raised position.

Still referring to FIGS. 1 and 1A, rudder blade 20 has a vertically oriented elongated slot 30 formed through an upper forward portion of the blade. Slot 30 rides on the cylindrical pivot pin 32 fixed transversely between rudder housing plates 16. Slot 30 has a width slightly larger than the diameter of pivot pin 32, and a length greater than the diameter of pivot pin 32, with rounded ends 30*a* and 30*b* that define first and second spaced pivot positions for the rudder blade. Slot 30 is generally vertical in the rudder's down position (FIG. 1), and generally horizontal in the rudder's up position (FIG. 4). Rudder blade 20 can accordingly both slide and pivot on pin 32.

Rudder blade 20 has a radiused upper front edge 20*b*, shaped, positioned and adapted to slide along a fixed cam pin 36 mounted between the rudder blade holders 16 in front of the rudder blade. The center of curvature of the radius of the front edge 20*b* is located at the center of upper end 30*a* of slot 30. Radiused upper edge 20*b* ends in a locking notch 20*c* having a diameter sized to receive pin 36 when they are aligned.

Figure 2:
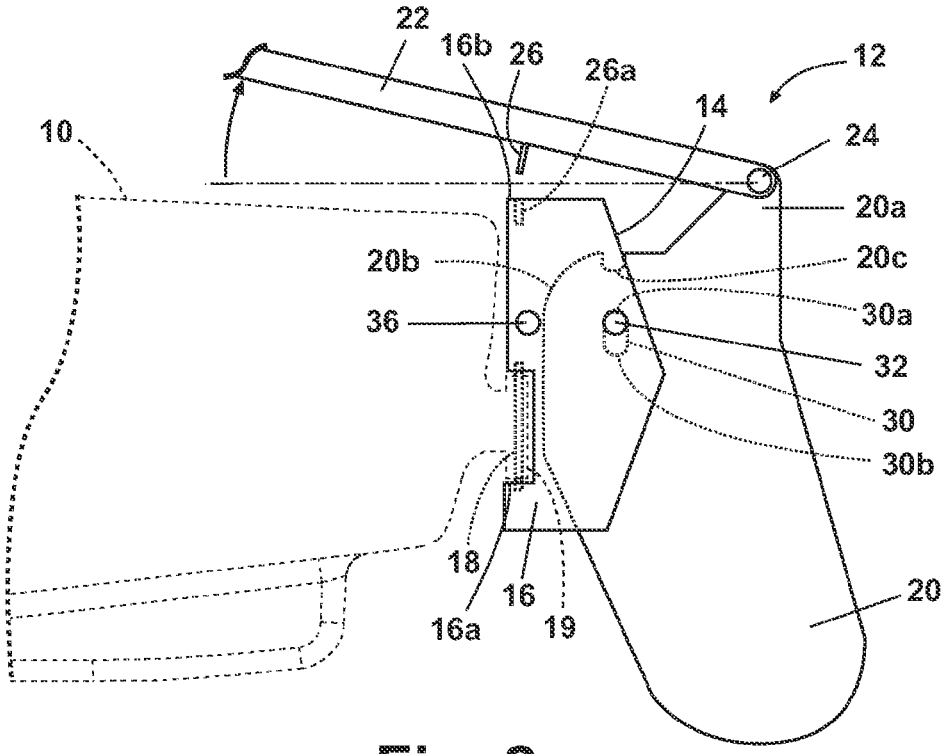
FIG. 2 is similar to FIG. 1, but shows the tiller lifted out of a fore-aft locking connection with the rudder housing before manually raising the rudder blade.
Figure 3:
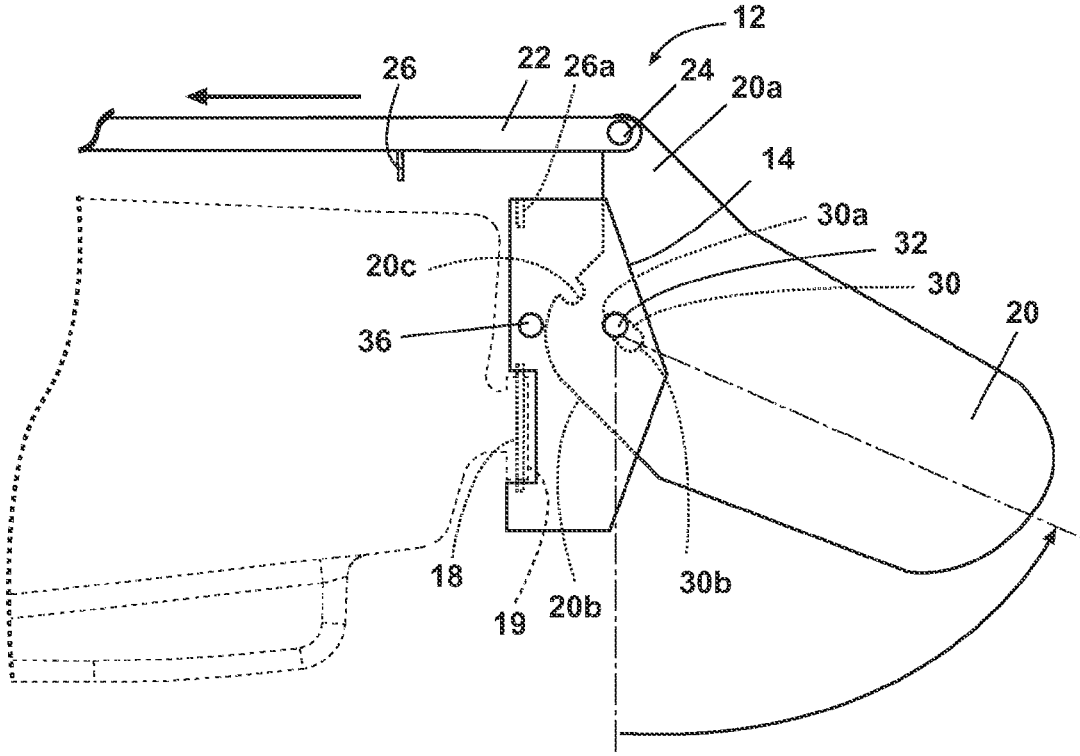
FIG. 3 shows the rudder blade manually raised partway by forward actuation of the tiller.

The manual rudder-raising sequence is illustrated in FIGS. 2-5. First, as shown in FIG. 2, tiller 22 is lifted up in an arc on pivot connection 24 until locking stud 26 clears hole 26*a*. Tiller 22 is now free to move forwardly of the boat. Pulling the tiller forward (FIG. 3) rotates rudder blade 20 upward around pivot pin 32, with radiused front edge 20*b* riding on front cam pin 36 to hold the pin 32 in place at the upper end 30*a* of slot 30.

The over-center location of the tiller's pivot connection 24 on rudder ear 20*a* and the shape and weight distribution of rudder blade 20 essentially limit the rudder blade's rotational arc during manual operation to the position shown in FIG. 4, in which the rudder blade is raised higher than the bottom of the boat, and is preferably completely out of the water. This raised, generally horizontal "up" position keeps the rudder blade 20 safely away from the lake bottom in shallows, away from dry land if the boat has been beached, and away from any anticipated underwater obstructions that the boat might be passing over. Notch 20*c* is in alignment with pin 36.

Figure 5:
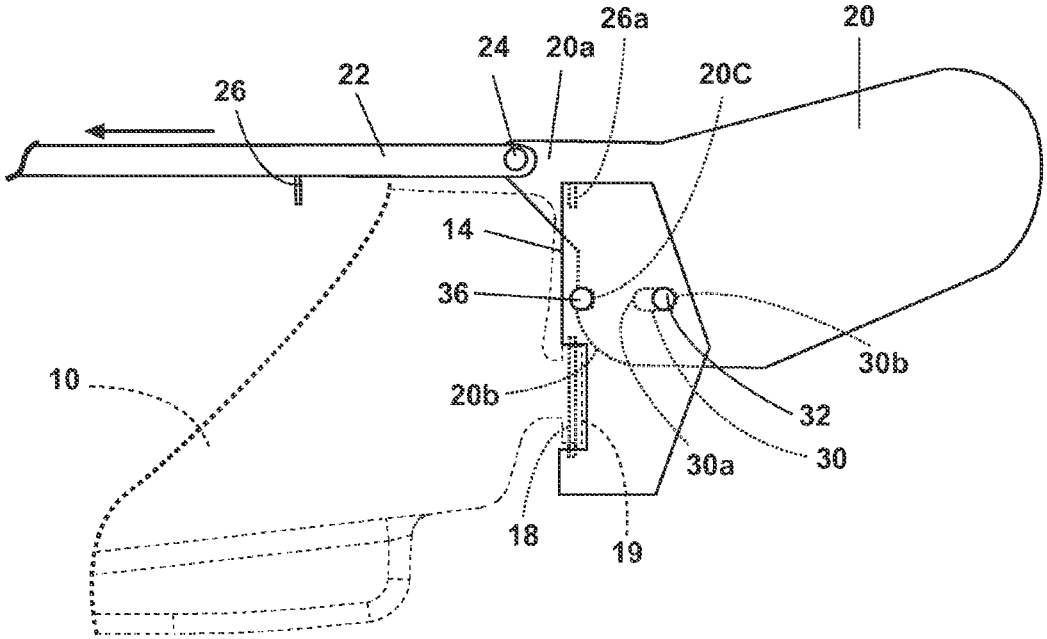
FIG. 5 shows the rudder blade locked in the raised position.

To lock rudder blade 22 in its raised position, tiller 22 is continued to be pulled forward which shifts notch 20*c* into engagement with pin 36 as shown in FIG. 5, and shifts the second end 30*b* of slot 30 onto pivot pin 32. The center of gravity of rudder blade 20 is located rearward of pivot pin 32 when the rudder blade is up as in FIG. 5, such that the weight of the rudder blade tends to maintain the cam pin 36 in locking notch 20*c* in the fully raised position. Rudder blade 20 cannot rotate back down in this raised-and-locked condition until the rudder blade is shifted horizontally aft via the tiller.

Figure 6:
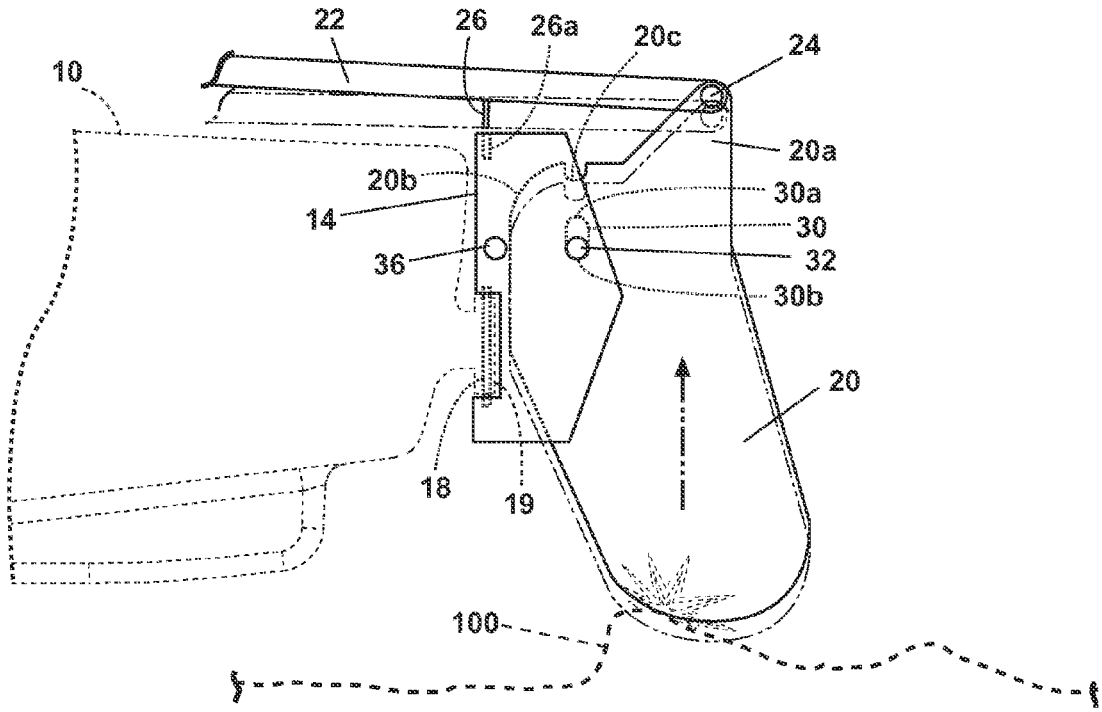
FIG. 6 shows the initial stage of automatic rudder kick-up after colliding with an underwater obstacle.
Figure 7:
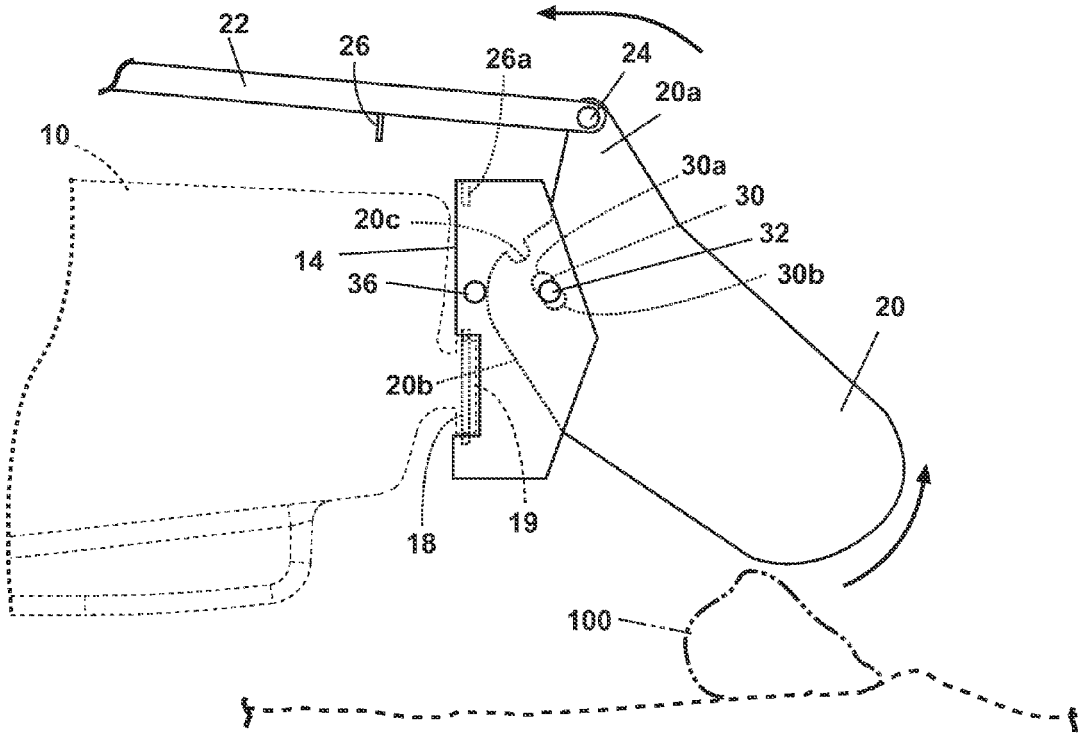
FIG. 7 shows the follow-up stage of automatic rudder kick-up as the underwater obstacle continues to exert force on the rudder.

FIGS. 6 and 7 illustrate the automatic two-stage kick-up of rudder blade 20 in response to collision with an underwater obstacle 100 (for example a rock, a log, a shoal, or a shallows where the boat operator has not manually raised the rudder). So long as the tiller is located in the locked-down position shown in FIG. 1, with the pin 26 in the stud receiver 26*a* and the pivot pin 32 in the upper end 30*a* of slot 30, the rudder 20 cannot pivot about pivot pin 32. However, in the event that the rudder hits an obstacle, for example, 100, as illustrated in FIGS. 6 and 7, the obstacle will cam along the curved forward edge of the lower end of the rudder blade 20 and thereby shift rudder blade 20 upwardly via slot 30 on pivot pin 32 from its original position (phantom lines in FIG. 6) to an unlocked position (solid lines in FIG. 6), in which the pin 26 is lifted out of the stud receiver 26*a*, thus freeing the rudder blade 20 to rotate about pin 32, and in which the lower end of the slot 30*b* hits pivot pin 32, the second pivot position. The boat's continued forward passage over the obstacle then forces rudder blade 20 back and up, initially pivoting on pin 32 in slot end 30*b*, but with the first slot end 30*a* of the rudder blade being progressively cammed back onto pin 32 by the action of radiused front edge 20*b* against cam pin 36. Rudder blade 20 will continue to pivot until the obstacle has been cleared, at which point the weight of the rudder blade pulls it back down into the lower, normal sailing position of FIG. 1. If rudder blade 20 is forced up by an obstruction even as far as the fully raised position of FIG. 4, the behind-the-pivot center of gravity of the rudder blade causes the weight of the rudder blade to automatically pivot it back down to the position shown in FIG. 2, where it can then be locked in the normal sailing position by the operator by lowering the tiller into the fore-aft locked position shown in FIG. 1. The boat operator can also quickly assist the rudder blade in clearing the obstacle by pulling the tiller forward after experiencing contact, since the fore-aft locking connection between tiller and rudder housing will have been released by the initial upward motion of the rudder blade.

When the rudder blade is in the up and locked position (FIG. 5) and the boat operator desires to have it in the sailing position (FIG. 1) he (she) may do so by pushing back on the tiller handle 22 which releases notch 20*c* from pin 36. This allows the rudder blade 20 to pivot back down into FIG. 2 position where the tiller handle 22 is then lowered engaging pin 26 with receiving hole 26*a* locking the rudder blade in the down position as shown in FIG. 1.

It will finally be understood that the disclosed embodiments are representative of presently preferred forms of the invention, but are intended to be illustrative rather than definitive of the invention. Reasonable variation and modification are possible within the scope of the foregoing disclosure and drawings without departing from the spirit of the invention.

What is claimed:

1. A kick-up rudder mechanism for a sailboat in which the rudder is steered manually with a hand tiller, comprising:

a rudder housing;

a rudder blade mounted to the rudder housing for pivotal movement relative to the rudder housing about a generally horizontal axis between a raised position and a lower position and for linear movement relative to the rudder housing along a generally vertical path when the rudder blade is in the lower position;

a tiller pivotally connected to the rudder blade; and a vertically-releasable fore-aft locking connection between the tiller and the rudder housing.

2. A kick-up rudder mechanism according to claim 1 wherein one of the rudder blade and the rudder housing includes an elongated vertical pivot slot and the other of the rudder blade and the rudder housing has a transverse pivot positioned in the slot for mounting the rudder blade for pivotal and linear movement.

3. A kick-up rudder mechanism according to claim 2 wherein the slot includes a first upper pivot end that normally rests on the transverse pivot when the rudder blade is in the rudder-down position, and a second lower pivot end that receives the transverse pivot when the rudder blade is shifted vertically up by a collision with an underwater obstacle in the rudder-down position.

4. A kick-up rudder mechanism according to claim 3 wherein the slot is so shaped and positioned so that the rudder blade can be shifted horizontally forward between the first and second pivot ends in the rudder-up position to lock the rudder blade in the rudder-up position.

5. A kick-up rudder mechanism according to claim 1 wherein the rudder blade is so configured and mounted to the rudder housing that the rudder blade is held in its down position by the weight of the rudder blade acting through a two-position pivot mechanism; whereby the pivot mechanism responds promptly and easily to collision and manual operation alike, and keeps the rudder blade securely down during normal sailing.

6. A kick-up rudder mechanism according to claim 1 wherein the rudder blade has an upper leading cam portion that cams against a cam on the rudder housing as the rudder blade moves between the lower and upper positions whereby moving the tiller fore and aft pivots the rudder blade up and down.

7. A kick-up rudder mechanism according to claim 6 wherein the rudder blade pivots through the elongated two-position pivot slot riding on the transverse rudder housing pin.

8. A kick-up rudder mechanism according to claim 7 wherein the rudder is biased to the lower position on the pivot pin by the weight of the rudder blade and an over-center connection to the tiller.

9. A kick-up rudder mechanism according to claim 8 wherein the rudder blade is secured by a vertically-released fore-aft locking connection between the tiller and the rudder housing.

10. A kick-up rudder mechanism according to claim 9 wherein the fore-aft locking connection is released automatically by the initial upward component of collision force on the rudder blade, which drives the rudder blade vertically on the pivot, and simultaneously releases the fore-aft locking connection so that the tiller can move forward and the rudder blade can pivot upwardly under continued force on the rudder.

11. A kick-up rudder mechanism according to claim 1 wherein the fore-aft locking connection is manually releasable by lifting the tiller upward on its pivot connection to the rudder and the tiller can then be pulled forward to pivot the rudder blade to the raised position.

12. A kick-up rudder mechanism according to claim 1 wherein an upper leading edge of the rudder blade is radiused for rotational sliding contact with a fixed cam pin on the rudder housing as the rudder blade pivots.

13. A kick-up rudder mechanism according to claim 12 wherein the rudder's radiused edge ends in a locking notch that receives the cam pin when the rudder is fully raised and the rudder blade is pulled forwardly onto the cam pin to lock the rudder in the raised position.

14. A kick-up rudder mechanism according to claim 13, wherein the weight of the rudder blade holds the locking notch in contact with the cam pin to retain the rudder blade in the raised and locked position.

15. A kick-up rudder mechanism according to claim 13, wherein the rudder blade can be released from the raised and locked position by the operator pushing back on the tiller handle.

* * * * *